US005165128A

United States Patent [19]

Honig

[11] Patent Number: 5,165,128

[45] Date of Patent: Nov. 24, 1992

[54] FITTED TOP BEDSHEET

[76] Inventor: Ethelyn Honig, 137 E. 95th St., New York, N.Y. 10128

[21] Appl. No.: 723,998

[22] Filed: Jul. 1, 1991

Related U.S. Application Data

[63] Continuation-in-part of Ser. No. 364,509, Jun. 9, 1989, Pat. No. 5,027,460, which is a continuation-in-part of Ser. No. 159,018, Feb. 19, 1988, abandoned.

[51] Int. Cl.[5] ..... A47G 9/00

[52] U.S. Cl. ..... 5/497; 5/482

[58] Field of Search ..... 5/482, 486, 494, 495, 5/496, 497, 498, 499,

[56] References Cited

U.S. PATENT DOCUMENTS

| | | | |
|---|---|---|---|
| 924,733 | 6/1909 | Carswell | 5/334 |
| 1,865,329 | 6/1937 | McHorter | 5/497 |
| 2,151,375 | 3/1939 | De Voe | 5/334 |
| 2,162,755 | 6/1939 | Shauer | 5/497 |
| 2,195,039 | 3/1940 | Shauer | 5/334 |
| 2,569,627 | 10/1951 | Black | 5/334 |
| 2,603,793 | 7/1952 | Crescenzi | 5/497 |
| 2,637,094 | 5/1953 | Andrews, Jr. | 5/334 |
| 2,662,234 | 12/1953 | Citron | 5/334 |
| 2,679,056 | 5/1954 | Simpson | 5/334 |
| 2,695,414 | 11/1954 | Ford et al. | 5/334 |
| 2,757,389 | 8/1956 | King | 5/334 |
| 2,788,532 | 4/1957 | Christley | 5/497 |
| 2,942,280 | 6/1960 | May, Jr. | 5/334 |
| 3,066,323 | 12/1962 | Kintner | 5/497 |
| 3,114,156 | 12/1963 | Cobb | 5/334 C |
| 3,181,179 | 5/1965 | Roddey, Jr. | 5/497 |
| 3,254,348 | 6/1966 | Addario | 5/497 |
| 3,273,175 | 9/1966 | Anderson et al. | 5/497 |
| 3,377,636 | 4/1968 | Di Addario | 5/497 |
| 3,438,068 | 4/1969 | Anderson et al. | 5/497 |
| 3,467,174 | 7/1969 | Deutsch | 5/496 |
| 3,654,646 | 4/1972 | McMahon | 5/334 C |
| 3,694,832 | 10/1972 | Jamison | 5/334 |
| 3,789,441 | 2/1974 | Weiss | 5/334 C |
| 3,868,735 | 3/1975 | Ross | 5/334 C |
| 3,962,739 | 6/1976 | Crockett | 5/497 |
| 3,966,633 | 12/1976 | Burke | 5/334 C |
| 4,021,869 | 5/1977 | Root | 5/334 C |
| 4,045,831 | 9/1977 | Clark | 5/334 R |
| 4,245,365 | 1/1981 | Large | 5/496 |
| 4,308,626 | 1/1982 | Weiss | 5/485 |
| 4,344,196 | 8/1982 | Large | 5/496 |
| 4,442,558 | 4/1984 | Alexander | 5/482 |
| 4,461,048 | 7/1984 | Allaire, Jr. | 5/497 |
| 4,461,049 | 7/1984 | Hammond | 5/498 |
| 4,615,061 | 10/1986 | Scott | 5/497 |
| 4,703,530 | 11/1987 | Gusman | 5/497 |
| 4,723,331 | 2/1988 | Weiss | 5/497 |
| 5,027,460 | 7/1991 | Honig | 5/497 |

FOREIGN PATENT DOCUMENTS

| | | | |
|---|---|---|---|
| 1067622 | 1/1980 | Canada | 5/497 |
| 871355 | 3/1962 | United Kingdom | 5/476 |

OTHER PUBLICATIONS

Sears Retail Sales Catalog, 1970, pp. 1526–7, 1534–5.

*Primary Examiner*—Eric K. Nicholson

*Attorney, Agent, or Firm*—Pennie & Edmonds

[57] ABSTRACT

A fitted top sheet of a generally rectangular blank of fabric material having two bottom corners, each corner cut away by three curved lines to form a junction having an angle of substantially 90°, to each of which a band of stretchable material is sewn, in stretched condition, to the outside edge of the cut corners and along the entire edge portion of the bottom of the blank, which cut corners are then joined by stitching at each corner and bottom edges thereof, thereby forming two expandable pockets for engaging the bottom corners and bottom portion of a mattress.

20 Claims, 11 Drawing Sheets

FITTED TOP BEDSHEET

CROSS REFERENCE TO RELATED APPLICATION

This application is a continuation-in-part of application Ser. No. 07/364,509, filed Jun. 9, 1989, now U.S. Pat. No. 5,027,460, which is a continuation-in-part of application Ser. No. 07/159,018 filed Feb. 19, 1988, now abandoned.

TECHNICAL FIELD

This invention relates to a useful improvement in bedsheets; more particularly an improvement of the top bedsheet.

BACKGROUND ART

It has been stated previously that after making a bed in the usual manner certain difficulties are encountered. The most annoying difficulty is that often the bottom portion of the top bedsheet will be kicked loose from the mattress by a restless sleeper at a time that is not conducive to remaking the bed, thereby causing chill and discomfort to the sleeper(s).

What has not been stated is the actual amount of time that is expended by an individual who must remake the entire bed due to the loosening of the top sheet only. For as the top sheet is kicked free, so too are the bed coverlets above it loosened. Depending upon the number of coverlets above the sheet, (an average of three in the winter; two blankets and a spread), it will take a minimum of ten minutes per day to remake an entire queen-sized bed. That means one (1) hour and ten (10) minutes per week, or sixty-one (61) hours per year to make just one bed. For a family of four members, daily bedmaking could take as much time as two hundred forty four (244) hours per year.

The previous art has laid claim to simplicity. Most, however, have complicated the process by adding snaps, zippers, buttons, hooks and eyes, velcro, stretchable materials not commercially available, or by the use of complicated fabric cutting processes. The latter require expensive manufacturing details as well as time consuming fussing for the bed-maker. The focus has remained on providing sufficient excess fabric material in the sheet for covering the feet without solving the problem of easing the burden of the daily task of remaking the bed for the bed-maker.

Manufacturers have provided us with fitted bottom sheets, but they have not taken the next step in providing a simple, yet effective, fitted top bedsheet, which enable the bed-makers to complete their tasks in a faster, easier manner. It is to this issue that this invention is directed.

SUMMARY OF THE INVENTION

The principal object of my invention is to provide for the manufacture of cost effective top sheets which are loose or free along three sides and are held in place along two corners and the remaining side. Preferably, the top and two sides of the sheet are free, and the sheet is held in place at the foot of the mattress by a band of stretchable material, such as elastic or an elastomer, which is sewn onto at least the lower portion of the corners and, if desired, to the entire side of the sheet connecting the corners.

Another object of my invention is to fabricate a bedsheet of the above type which is simple in construction.

In this embodiment, the top sheet has elastic portions only on two corners thereof. As above, it is advantageous for these two corners to be at the foot of the sheet. Also, by fitting the bottom part of the top sheet in this manner, the sheet is automatically centered on the bed so as to save time for the bed-maker on that operation.

Two adjacent corners of the sheet are cut away by at least one and preferably three curved lines to form first and second adjacent junctions each having two legs of equal length and configuration, and forming an angle of substantially 90° in each of the two adjacent corners. The legs are joined by stitching to form the stitched corners.

BRIEF DESCRIPTION OF THE DRAWINGS

With these objects in view, the invention will more fully appear by following the description, the appended claims and the accompanying drawing figures, wherein:

DETAILED DESCRIPTION OF THE PREFERRED EMBODIMENTS

Figure 1:
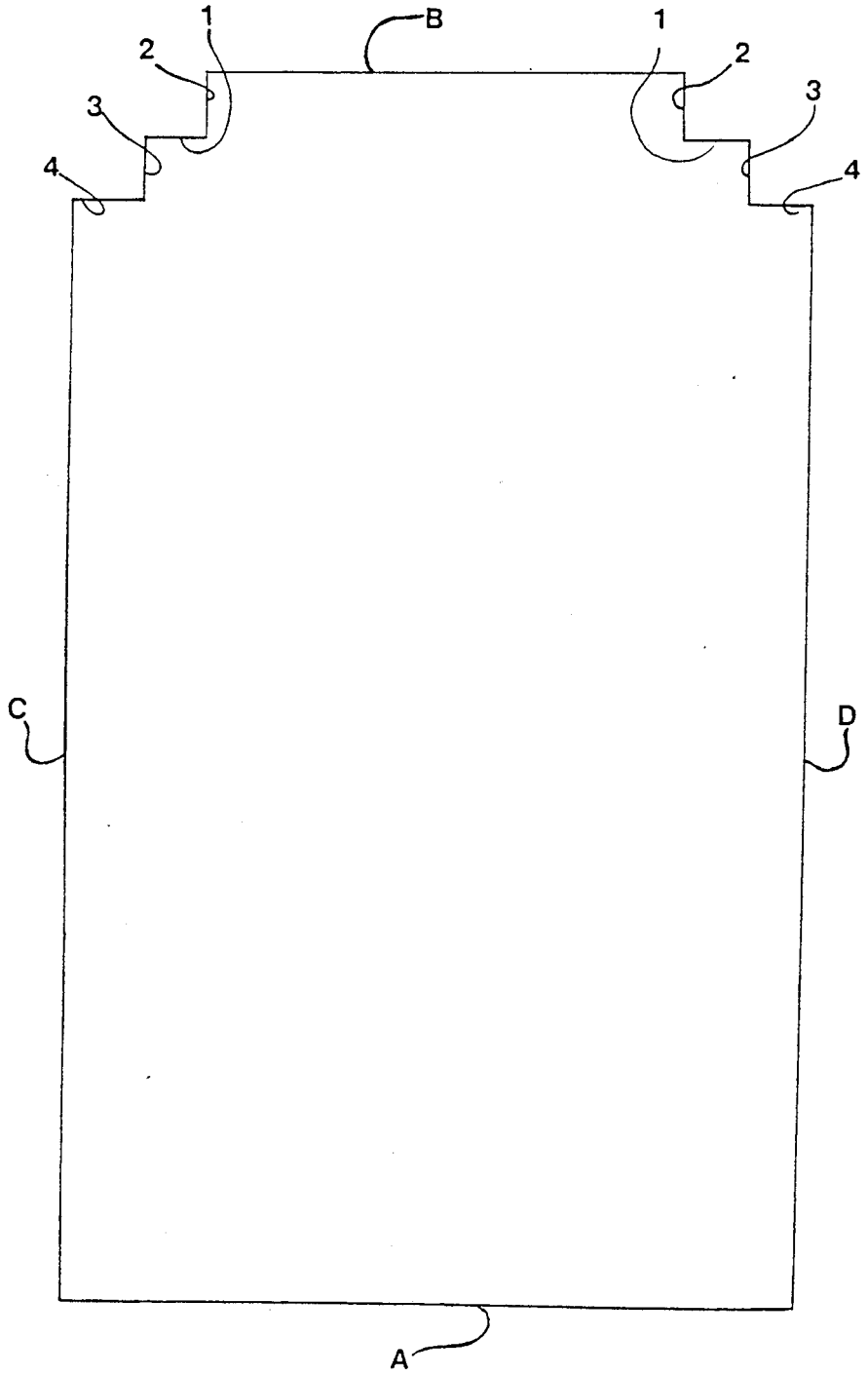
FIG. 1 is an open plan view of a blank piece of flexible material from which the top sheet for a bed is constructed and illustrates two cut out portions at the bottom corners of two sides of the sheet.

Referring initially to FIG. 1, reference letters A, B, C and D indicate the four sides of a rectangular blank of fabric material from which the top sheet, comprising the present invention, may be fabricated. Two pieces of fabric, forming two square notches 1, 2, 3, 4, are cut from the sheet at two adjacent corners during the manufacturing process. At each corner, an additional straight cut 1 is made parallel to cut 4 and adjacent and perpendicular to cut 3. Cut 2 is curved from its point of intersection with cut 1 and the bottom of the sheet B.

The fitted top sheet of the present invention may be formed of any conventional sheet fabric, woven or knitted. If knitted fabric is used, for example, special advantages are realized. The use of knitted fabric, particularly two-way stretch cotton, polyester, or a blend, provides a sheet which can easily be fitted onto a large range of mattress sizes, and which will closely and neatly adhere to the mattress.

Figure 2:
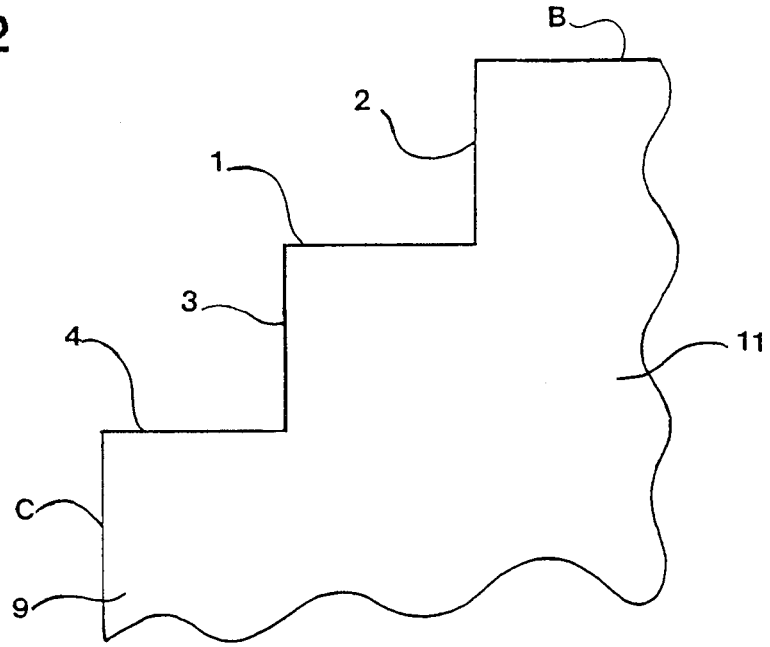
FIG. 2 is a fragmentary plan view of one of the two corners.

FIG. 2 illustrates a fragmentary view of the cuts 1, 2, and 3, 4 at the bottom 11, B of one side C, 9.

Figure 3:
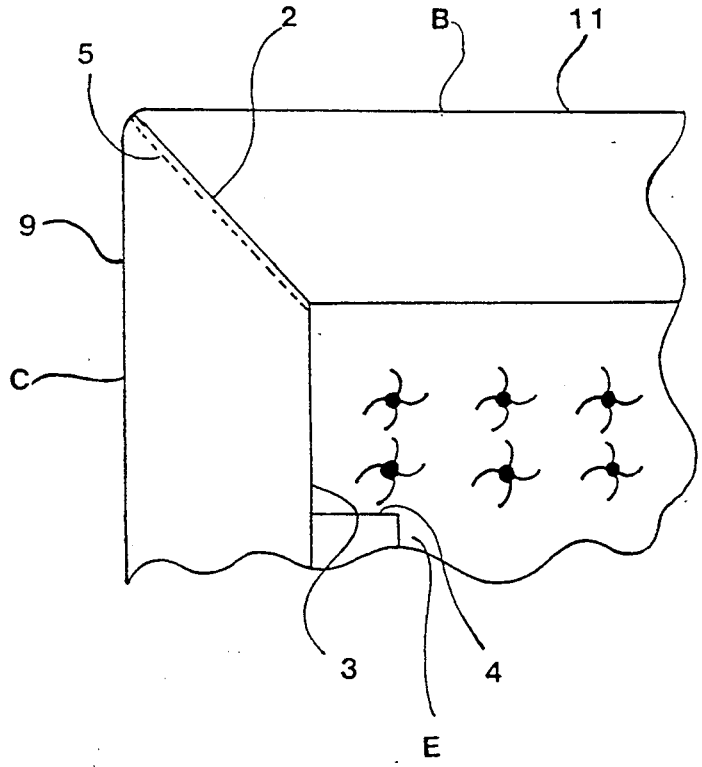
FIG. 3 is a fragmentary plan view of one of the bottom corners of the underside of the mattress and illustrates that portion of the sheet after two edges of the corner have been joined by stitching, when the sheet is in a stretched position.

FIG. 3 illustrates one particular way in which the corner may be formed. From the bottom of the mattress E, it is seen that a pocket is formed 9, 11 by sewing cut edge 1, 2 as indicated by the dotted line 5. This forms a pocket which captures the corners at the foot and bottom of the mattress E.

Figure 4:
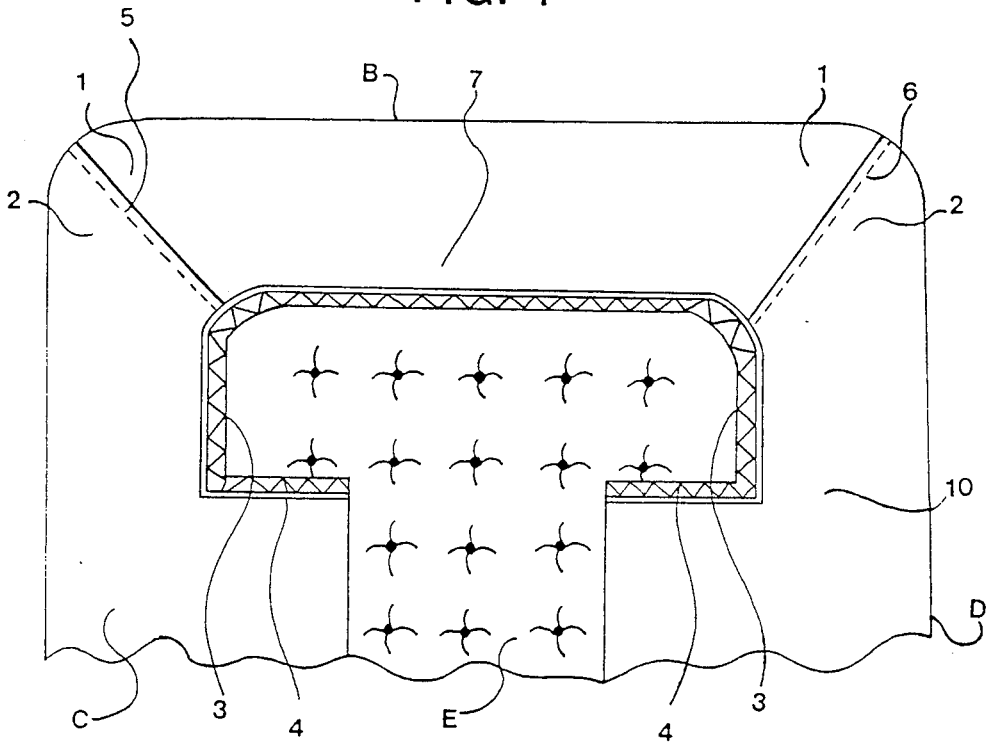
FIG. 4 is a fragmentary plan view of the underside of the foot of the mattress illustrating where the band of elastic is to be attached to the bottom part and two sides of the sheet, all of which are shown in stretched position.

In FIG. 4, both stitched 5, 6 corners are shown as they would appear from the bottom of the mattress E, illustrating where a band of elastic 7, in stretched position, is to be continuously sewn along the entire length of the edge of the bottom of the sheet B and on both sides 9, 10. It is preferable that the band 7 be made of elastic or an elastomer. Spandex or Lycra are preferred types of elastic that have been found to be very durable during numerous launderings. The length of sewing of expandable material should extend about six inches along the side of the sheet adjacent corners 3, 4.

Figure 5:
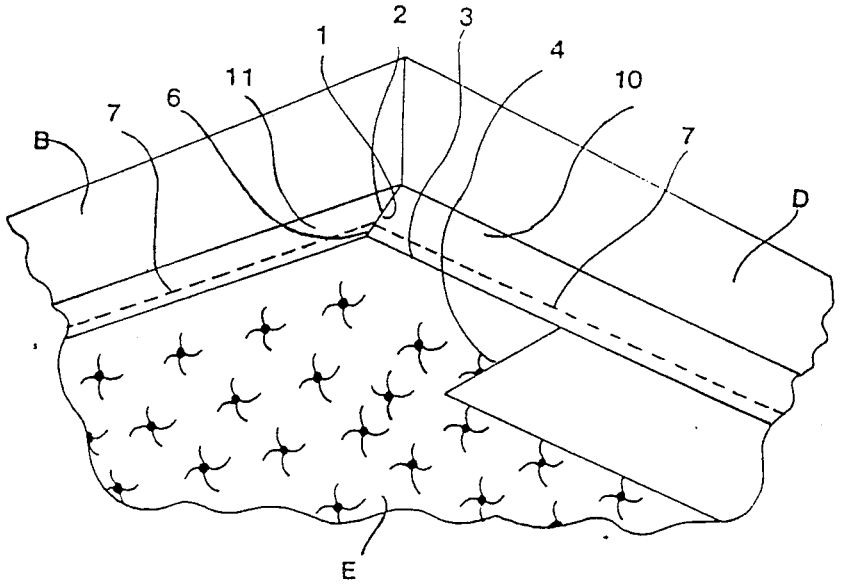
FIG. 5 is an enlarged fragmentary perspective view of the underside of one corner of the foot of the mattress illustrating the portion of the sheet as it captures the mattress in its stretched position and illustrates, as well, that the stitching and elastic band are facing the mattress.

FIG. 5 is an enlarged fragmentary perspective view of the bottom of one corner of the mattress E showing the band of elastic 7 with the sheet in place in stretched position. This view illustrates that the band of elastic 7, shown with dotted lines, has been stitched to that side of the sheet that is facing the mattress, so that no stitching is visible when the sheet is on the bed.

Figure 6:
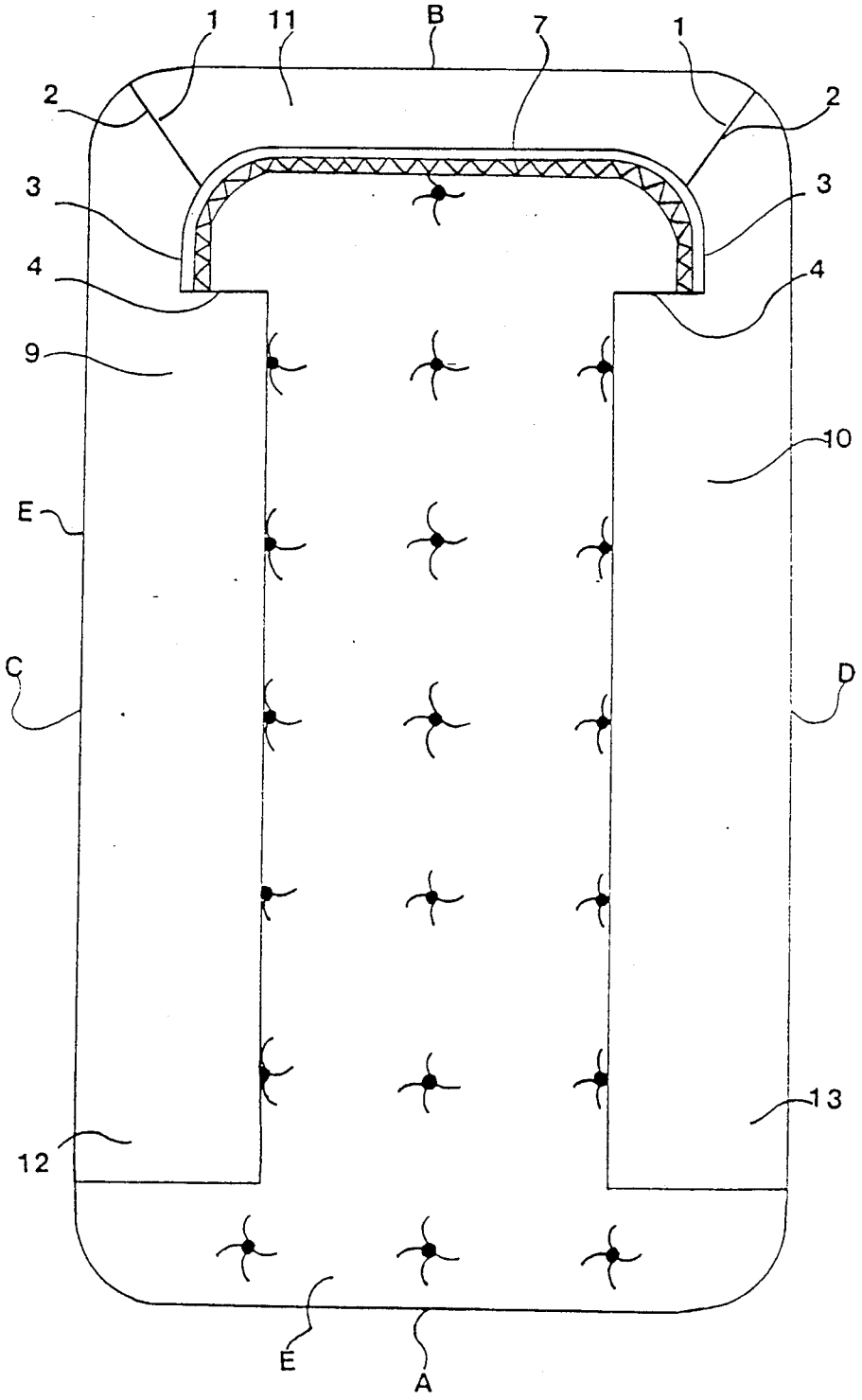
FIG. 6 is a plan view of the entire underside of the mattress.

FIG. 6 is a plan view of the entire bottom of the mattress E. Mention will be made of the bottom sheet which, it is assumed, will be of the fitted variety and here is in place directly facing the mattress. The top sheet will be fitted over the bottom sheet at the foot of the mattress B, 2, 11, 3 and partially up on either side 9, 10. The remaining "loose" sides of the sheet are tucked under the mattress E.

Figure 7:
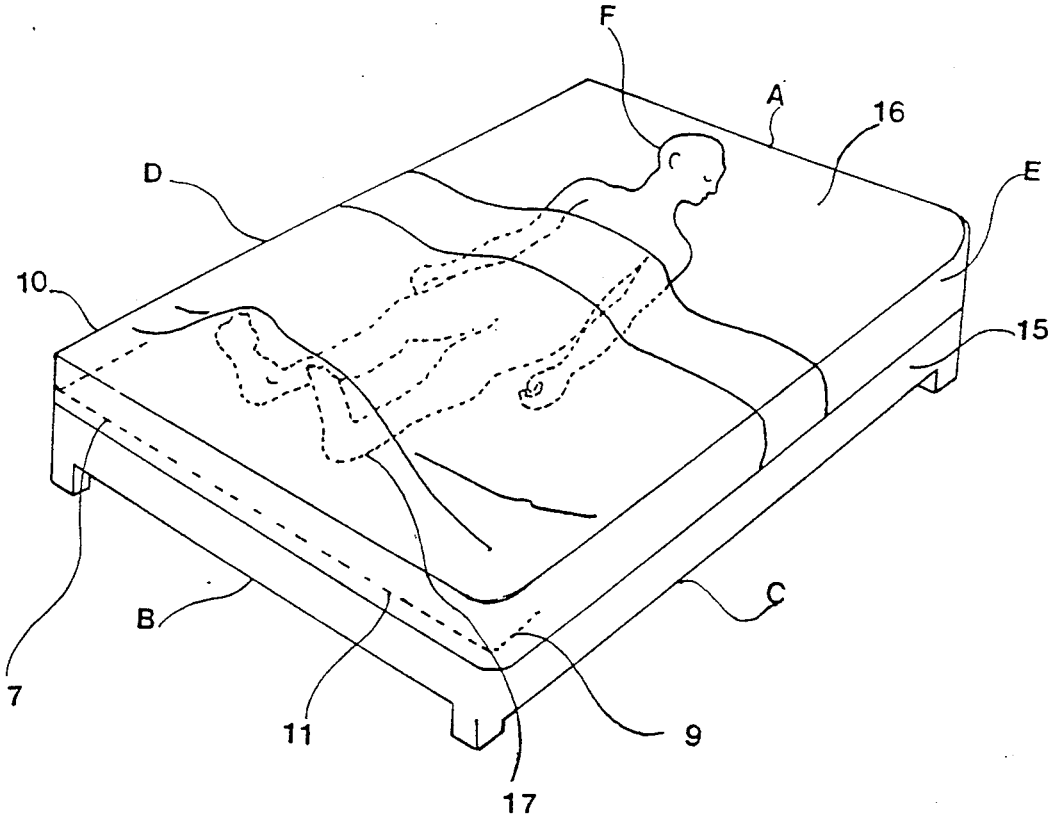
FIG. 7 is a perspective top view of the bed showing a person beneath the top sheet which is in position on the bed.

FIG. 7 is a perspective view of a person 14 lying on a bed 15 under the top bedsheet ABCD which is in place to illustrate that a sufficient amount of foot room 17 is present between the top sheet and the bottom sheet 16 which is fitted to the mattress E without the need to provide additional fabric material in the sheet. The band of elastic in the top sheet 7 allows for this room since the bottom of the sheet and bottom of two longitudinal sides 9, 10 stretch and contract to allow for comfortable foot room.

As noted above, it is possible and often desirable to provide the top sheet with stretchable material only in the cut corners to reduce the amount of stretchable material used in making the sheet and to correspondingly reduce the cost thereof. Furthermore, compared to prior art fitted top sheets, the present invention enables the manufacturer to reduce the amount of fabric used therein.

If desired, the top sheet can be fitted in the two corners which are located along a longitudinal side of the sheet, rather than at the bottom. This feature is useful for beds which have one side placed against a wall or in other confined areas where it is not easy for the bedmaker to gain access to that side of the bed for making thereof. This feature is more practical in beds used by only one person, such as, for example, a twin bed.

Figure 8:
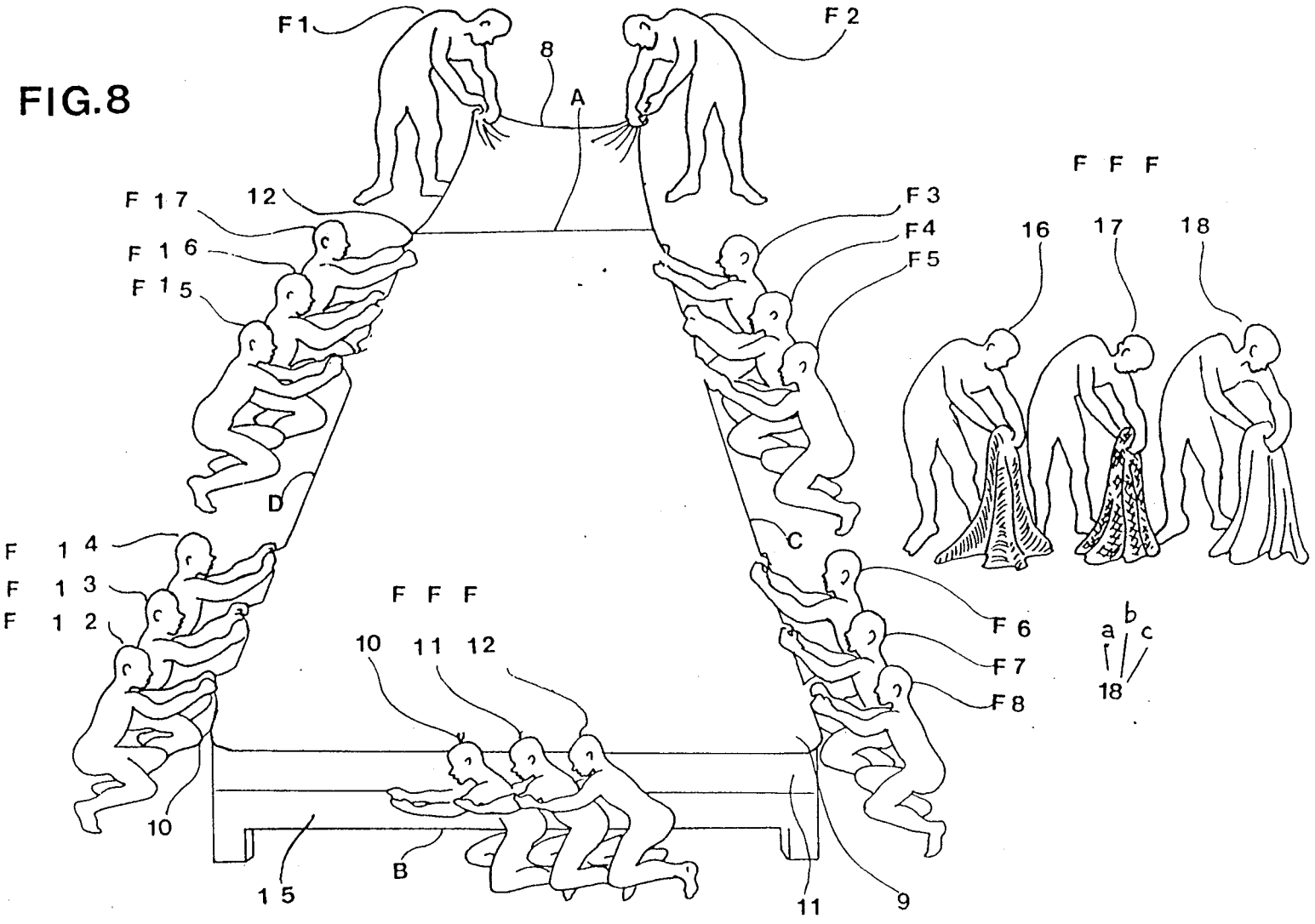
FIG. 8 is a perspective view of the top of the entire bed according to the prior art illustrating the numbers of different actions it takes for one person to remake the bed without having a top fitted bedsheet.

FIG. 8 is a perspective view of the entire top of the bed A, B, C, D illustrating the number of different actions it takes for one person F 1 through F 17 to remake a bed comprising two blankets 18*a*, 18*b* and a spread coverlet 18*c* which does not have a fitted top sheet 9, 10, 11, 12. Each figure represents the same person having to repeat three (3) times the same action of tucking under the mattress the sheet, two blankets 18*a* and 18*b*, the spread coverlet 18*c*, and folding the top of the sheet 8 over the blankets. It will be observed that seventeen (17) actions of effort take place in order to remake the bed.

Figure 9:
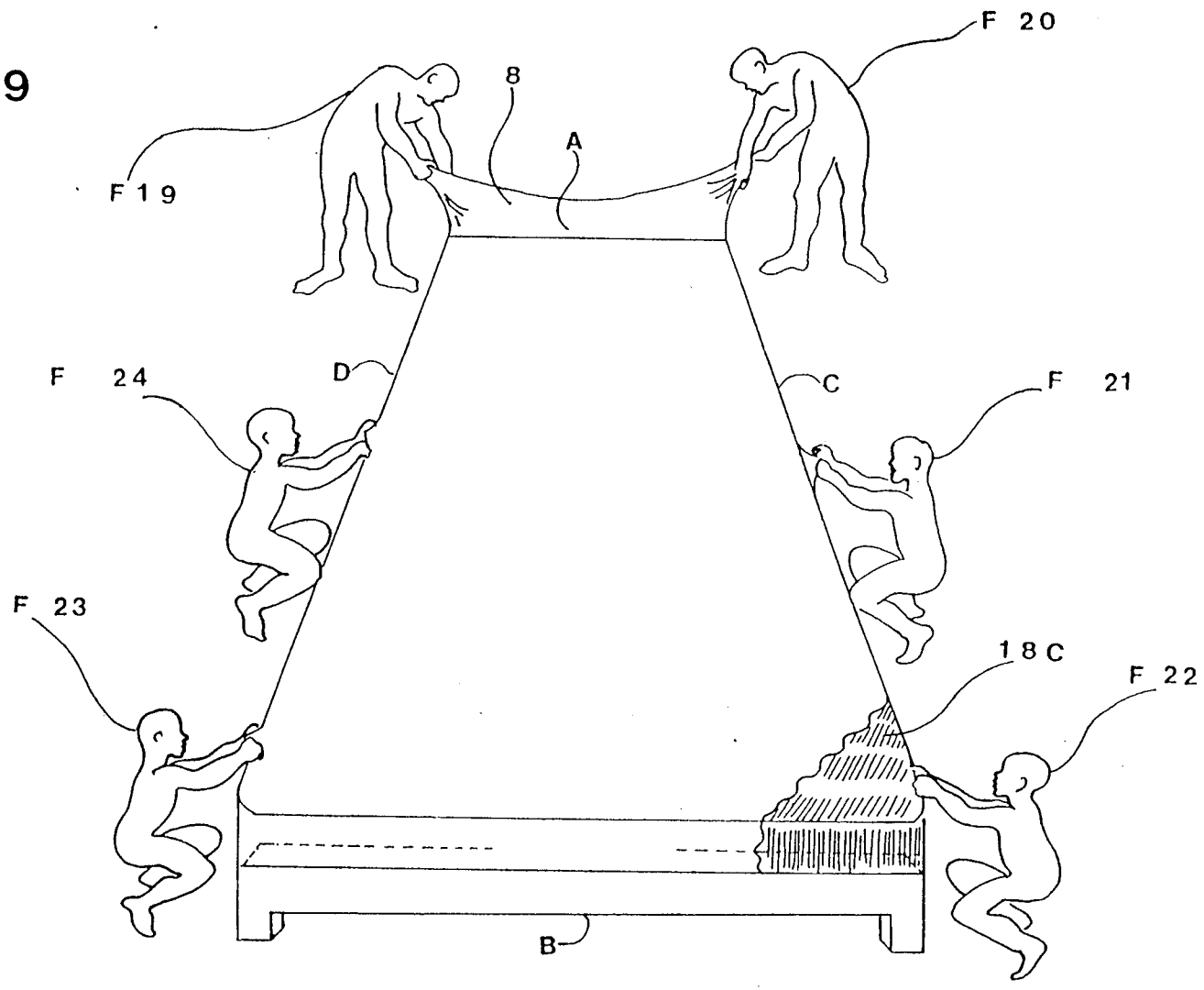
FIG. 9 is a perspective view of the top of an entire bed illustrating the numbers of different actions it takes for one person to remake the bed having a top fitted bedsheet.

FIG. 9 is again a perspective view of the top of a similar bed A, B, C, D illustrating the number of actions it takes the same person 19 through 24 to remake the bed A, B, C, D when a fitted top sheet according to the invention is used on the mattress. In this instance all of the blankets have remained in place at the bottom of the bed B and the person need only to pull the top sheet up toward the head of the bed F19, F20 and tuck all of the bed covers together under the sides C, D of the mattress. I am assuming that the bed coverlet has been left in place on the top of the bed at night 18*c*. In this instance, it should be seen that only six (6) actions of effort will be needed to remake the bed; thus reducing the time to make the bed by more than half through a substantial reduction in the number of operations needed.

Taking into consideration that the length of the sides of the top sheet might need to be shorter or wider than the bottom sheet, there are alternative ways of cutting the blank piece of material FIG. 1 which would allow the two sides C, D to have more or less material, as desired. Generally, the wider sides are preferred since more material would be available to be tucked under the mattress and to provide more freedom of movement for a body.

Figure 10:
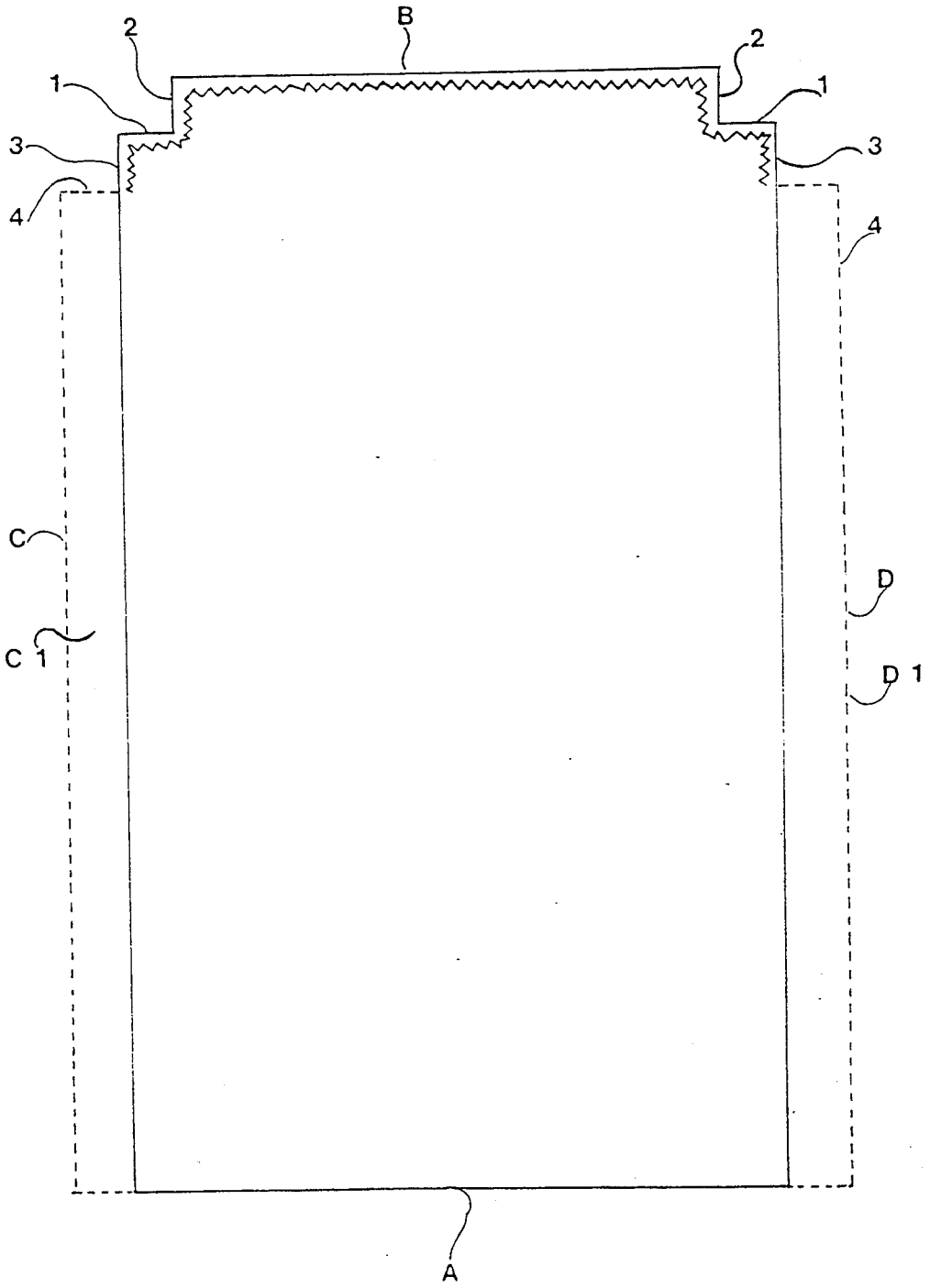
FIGS. 10–12 are plan views of additional blanks which can be used for forming fitted top bedsheets according to the invention.
Figure 11:
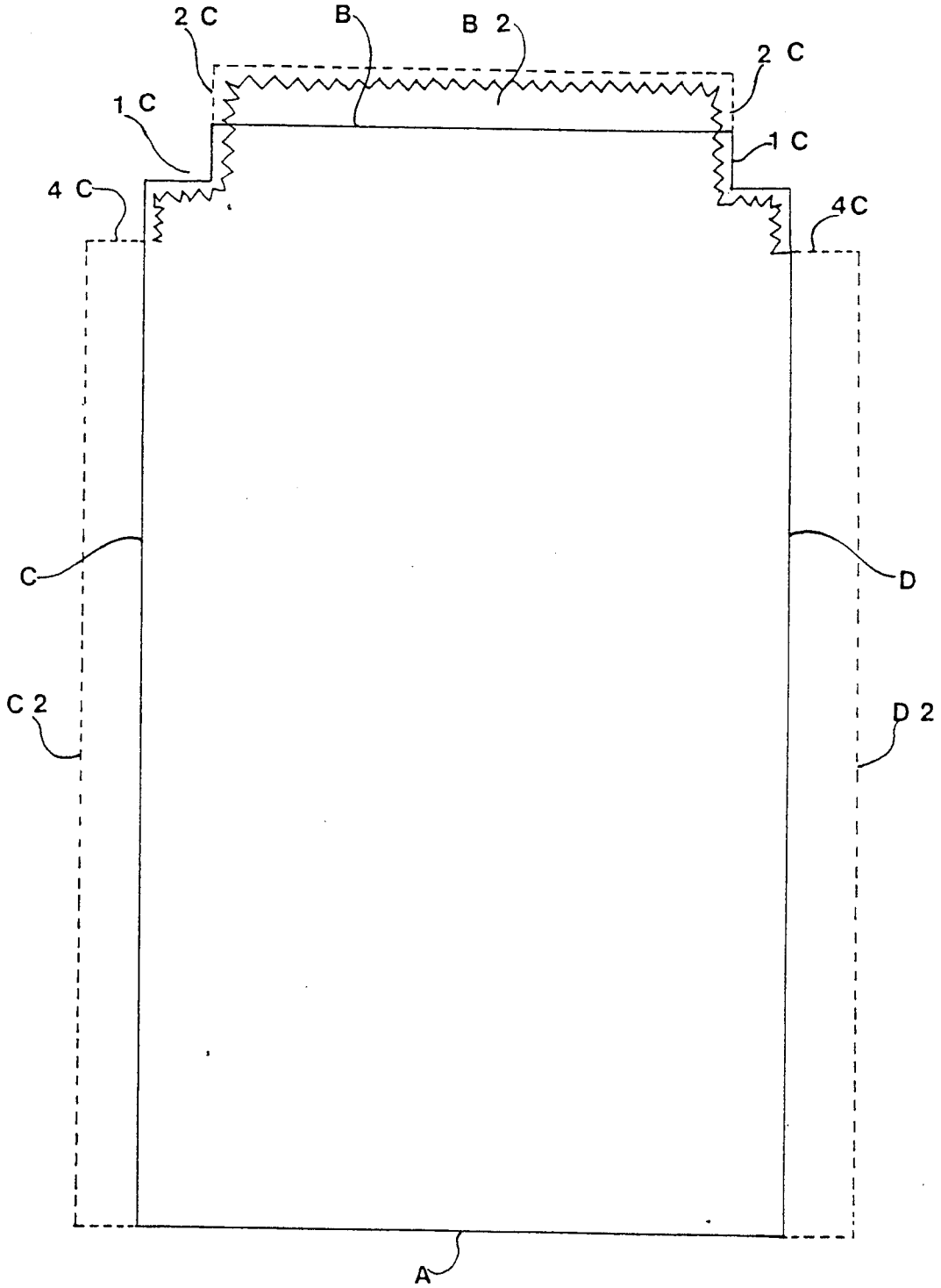

One alternative is shown in FIG. 10 where the configuration of the blank piece of material A, B, C, D is changed so that side 4 of the cut edges 3, 4 would be cut from the blank, thereby allowing less material along the two sides, C1 and D1. Another alternative is shown in FIG. 11 where the cut edges 1, 2 are cut more deeply than in FIG. 1, which would cause a deeper pocket when the sides are sewn as illustrated in FIG. 3, without changing the length of the material on sides, C2 and D2. Yet a third alternative, shown in FIG. 12, could be the use of the same cut edges 1, 2, as in FIG. 1 but here the material along sides A, B, C, D are shown with the sides C3 and D3 cut at a diagonal along the sides of the sheet.

Figure 13:
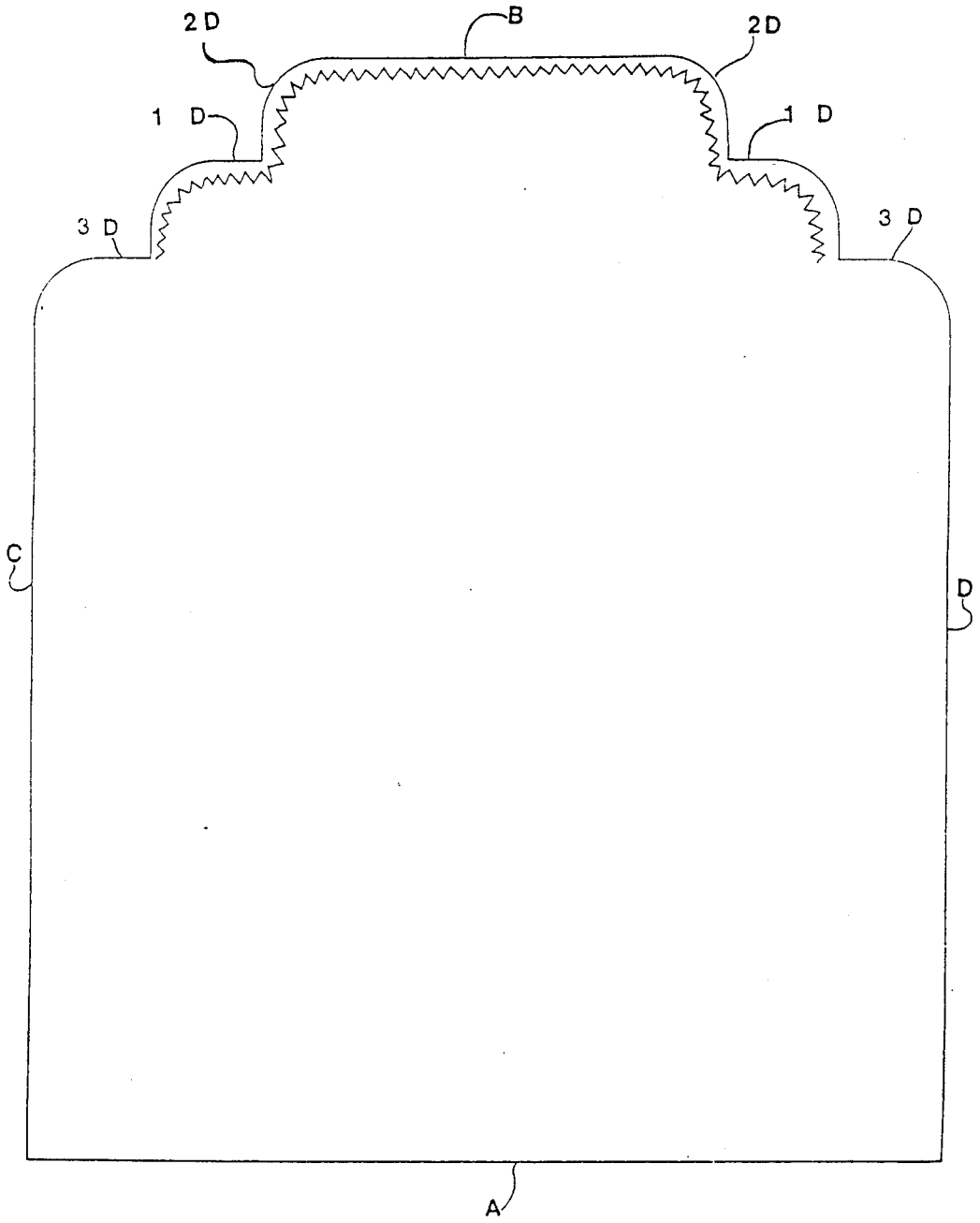
FIG. 13 is a plan view of an additional embodiment of a fitted top sheet according to the invention.

Finally, FIG. 13 illustrates an alternative embodiment where cut edges 1D, 2D, 3D are made by curved, rather than straight, lines. Each of the curved or rounded corners 1D, 2D, 3D are made by an automated blade which cuts stacked layers of fabric blanks prior to sewing the corners together. It is not necessary for cut 3D to be curved although with the automated blade this is the usual configuration. Thus, cut 3D can be a straight cut perpendicular to sides C, D of the blank. Likewise, the start of curved cut 2D at side B of the sheet is optional as cut 2D could be a straight cut perpendicular to side B of the blank.

The embodiment of FIG. 13 can be used in combination with the increased width sides of the sheet of FIG.

Figure 12:
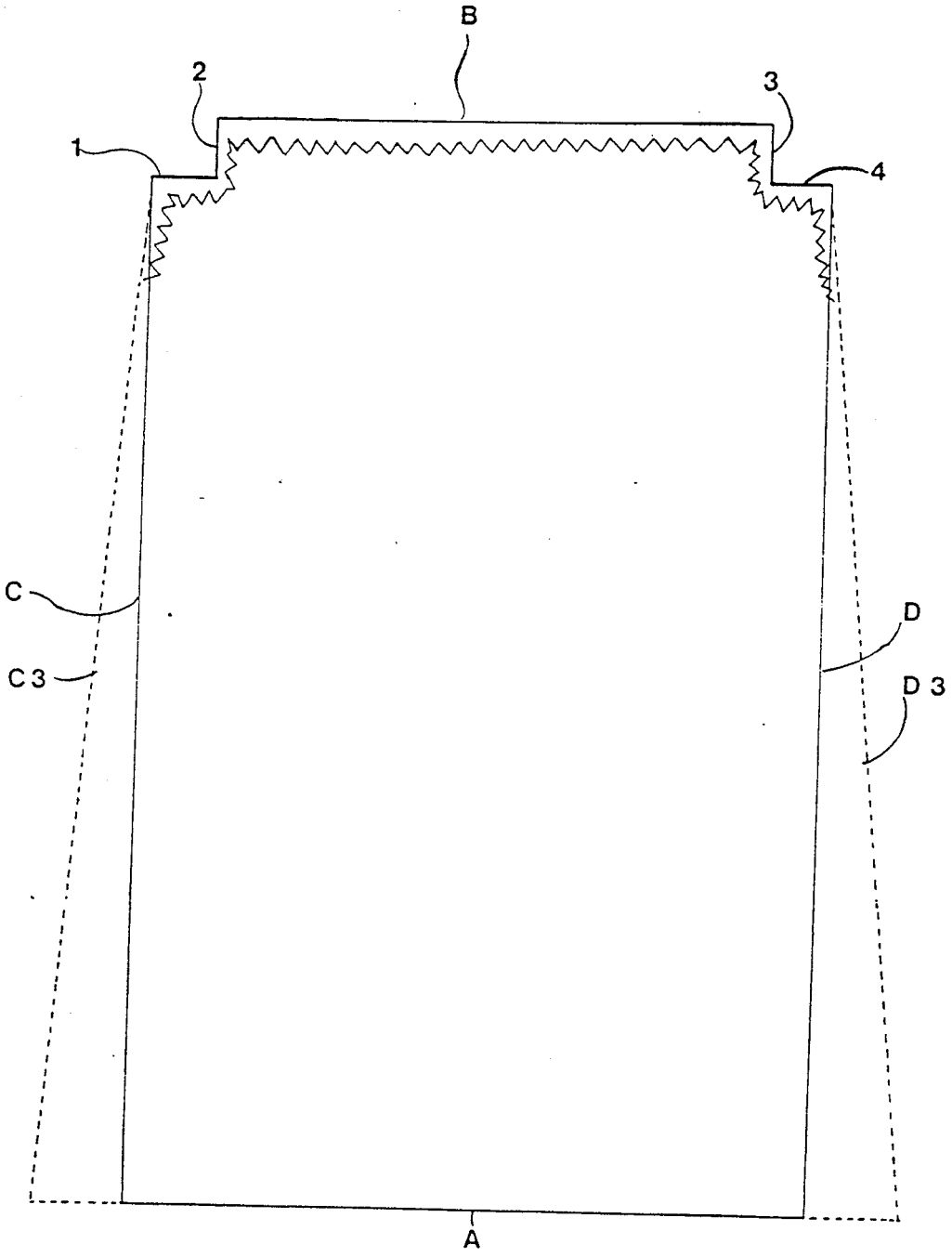

10, the increased length of the sheet of FIG. 11, or the tapered sides of the sheet of FIG. 12. In each of these combinations, the cut corners of the sheet would be as shown in FIG. 13.

For FIGS. 10–13, all of the wiggly lines show where the bands of the elastic will be sewn onto the sheet.

While it is apparent that the invention herein disclosed is well calculated to fulfill the objects above stated, it will be appreciated that numerous embodiments and modifications may be devised by those skilled in the art, and it is intended that the appended claims cover all such modifications and embodiments as fall within the true spirit and scope of the present invention.

What is claimed is:

1. A fitted top sheet comprising a generally rectangular blank of material having four sides, two top corners and two bottom corners, each bottom corner being cut away by three adjacent lines to form first and second adjacent junctions, each line having a curved portion between substantially straight end portions, and each junction formed by the intersection of the end portions from two adjacent lines and having an angle of substantially 90°, wherein two such junctions are formed in each of said cut bottom corners, wherein the two adjacent lines of each first junction are joined by stitching to form a stitched corner and wherein along a portion of the adjacent line of the second junction at each stitched corner and along an edge portion of the bottom of said blank, a band of stretchable material, in stretched condition, is sewn to form an expandable corner pocket in each stitched corner for engaging the bottom corners of a mattress and wherein the two top corners of the blank of material are not cut.

2. The bedsheet of claim 1 having instead the stretchable material on the entire side of the bottom in addition to both said bottom corners of said sheet bottom; allowing enough stretchable material to permit the formation of an expandable pocket at the bottom of the sheet for capture of the bottom and corners of said mattress.

3. A fitted top sheet comprising a blank of material having four sides and four corners, with two adjacent corners each being cut away by three adjacent lines to form first and second adjacent junctions, each line having a curved portion between substantially straight end portions, and each junction formed by the intersection of the end portions from two adjacent lines and having an angle of substantially 90°, wherein two such junctions are formed in each of said cut corners, wherein the two adjacent lines of one of the junctions in each cut corner are joined by stitching to form a stitched corner and wherein along a portion of the adjacent line of the other junction at each stitched corner and along an edge portion of the side of the blank extending between adjacent corners, a band of stretchable material, in stretched condition, is sewn to form two expandable corner pockets for engaging two corresponding adjacent corners of a mattress and wherein the other two corners of the blank of material are not cut.

4. The bedsheet of claim 3 wherein the stretchable material extends along an edge portion of the side of the bedsheet between said adjacent cut corners to form an edge which engages one side of mattress.

5. The bedsheet of claim 3 wherein the two cut corners are located on the bedsheet to correspond to the foot of the mattress.

6. The bedsheet of claim 4 wherein the two cut corners are located on the bedsheet to correspond to the foot of the mattress and wherein the stretchable material extends along the side of the bedsheet for engaging the bottom of the foot of the mattress.

7. The bedsheet of claim 3 wherein opposite sides of the bedsheet are tapered from the cut corners to provide a larger width of the bedsheet at the head of the mattress.

8. A fitted top sheet consisting essentially of a generally rectangular blank of material having four sides and four corners with two adjacent corners each being cut away by three adjacent lines to form first and second adjacent junctions, each line having a curved portion between substantially straight end portions, and each junction formed by the intersection of the end portions from two adjacent lines and having an angle of substantially 90°, and where two such junctions are formed in each of said cut corners, wherein the two adjacent lines of one of the junctions in each cut corner are joined by stitching to form a stitched corner and wherein along a portion of the adjacent line of the other junction at each stitched corner and along an edge portion of the side of the blank extending between adjacent corners, a band of stretchable material, in stretched condition, is sewn to form two expandable corner pockets for engaging two corresponding adjacent corners of a mattress and wherein the other two corners of the blank of material are not cut.

9. The bedsheet of claim 8 wherein the stretchable material extends along an edge portion of the side of the bedsheet between said adjacent cut corners to form an edge which engages one side of mattress.

10. The bedsheet of claim 8 wherein the two cut corners are located on the bedsheet to correspond to the foot of the mattress.

11. The bedsheet of claim 8 wherein the two cut corners are located at the foot of the mattress and wherein the stretchable material extends along the side of the bedsheet for engaging the bottom of the foot of the mattress.

12. The bedsheet of claim 10 wherein opposite sides of said bedsheet are tapered from the cut corners to provide a larger width of the bedsheet at the head of the mattress.

13. A method for reducing the number of steps and time for remaking a bed comprising providing a bed with a fitted top bedsheet according to claim 1 so as to avoid tucking a large amount of material at the foot of said bedsheet under the mattress and to enable one to only pull the top bedsheet up toward the head of the bed, followed by tucking any additional bed covers under the sides of the mattress.

14. A method for reducing the number of steps and time for remaking a bed comprising providing a bed with a fitted top bedsheet according to claim 2 so as to avoid tucking a large amount of material at the foot of said bedsheet under the mattress and to enable one to only pull the top bedsheet up toward the head of the bed, followed by tucking any additional bed covers under the sides of the mattress.

15. A method for reducing the number of steps and time for remaking a bed comprising providing a bed with a fitted top bedsheet according to claim 3 so as to avoid tucking a large amount of material at the foot of said bedsheet under the mattress and to enable one to only pull the top bedsheet up toward the head of the bed, followed by tucking any additional bed covers under the sides of the mattress.

16. A method for reducing the number of steps and time for remaking a bed comprising providing a bed with a fitted top bedsheet according to claim 8 so as to avoid tucking a large amount of material at the foot of said bedsheet under the mattress and to enable one to only pull the top bedsheet up toward the head of the bed, followed by tucking any additional bed covers under the sides of the mattress.

17. The method of claim 13 which further comprises automatically centering the top bedsheet on the mattress by engaging the bottom portion thereof with the foot of the mattress.

18. The method of claim 14 which further comprises automatically centering the top bedsheet on the mattress by engaging the bottom portion thereof with the foot of the mattress.

19. The method of claim 15 which further comprises automatically centering the top bedsheet on the mattress by engaging the bottom portion thereof with the foot of the mattress.

20. The method of claim 16 which further comprises automatically centering the top bedsheet on the mattress by engaging the bottom portion thereof with the foot of the mattress.

* * * * *